United States Patent [19]

Bell, Sr. et al.

[11] 4,427,058

[45] Jan. 24, 1984

[54] HRSG SIDEWALL BAFFLE

[75] Inventors: Frederic C. Bell, Sr., Newburyport; George T. Nicholson, Lynn; Russell L. Shade, Jr., Boxford; David R. Skinner, Georgetown, all of Mass.

[73] Assignee: General Electric Company, Lynn, Mass.

[21] Appl. No.: 449,448

[22] Filed: Dec. 13, 1982

[51] Int. Cl.[3] ..... F22B 1/18; F22B 37/68; F28F 13/06

[52] U.S. Cl. ..... 165/160; 122/32; 122/44 A; 122/155 A; 122/510; 165/162

[58] Field of Search ..... 165/160, 161, 162, 172; 122/44 A, 155 A, 510, 32, 34

[56] References Cited

U.S. PATENT DOCUMENTS 2,608,388 8/1952 Miller ..... 165/172

*Primary Examiner*—Sheldon J. Richter

*Attorney, Agent, or Firm*—James W. Mitchell

[57] ABSTRACT

In a non-contact heat exchanger such as a heat recovery steam generator, the performance efficiency is dependent upon full utilization of the available hot gas flow. In a heat recovery steam generator, hot gas is channeled past fluid carrying tubes whereby the tube-side fluid (water) is heated into steam. It has been discovered that gas flow along the heat exchanger sidewalls results in an unacceptable heat loss and that this loss may be corrected by the use of sidewall baffles so constructed as to obviate any alignment difficulty.

9 Claims, 6 Drawing Figures

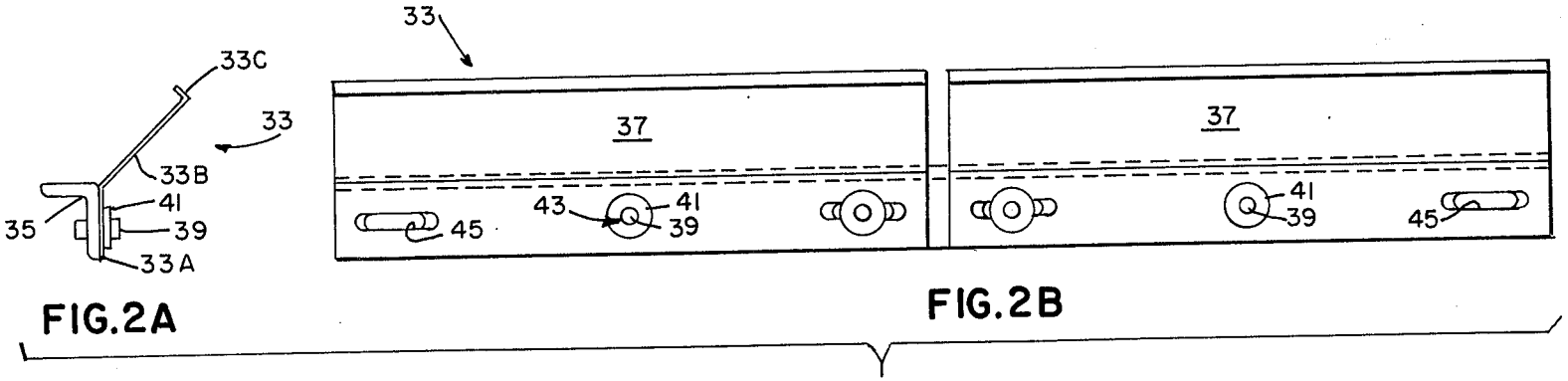
FIG. 2A
FIG. 2B
FIG. 2
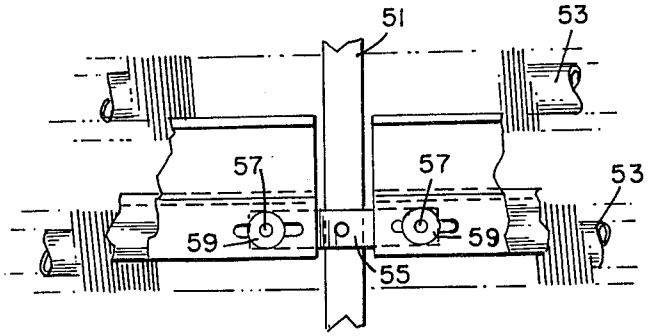
FIG. 3

HRSG SIDEWALL BAFFLE

BACKGROUND OF THE INVENTION

This invention relates in general to heat exchangers; and, in particular, to an improved design noncontact heat exchanger as, for example, a heat recovery steam generator for a combined cycle power plant.

Heat recovery steam generators (HRSG's) are noncontact heat exchangers comprising a gas carrying duct having heat exchanger tubes mounted within the duct. As is shown in U.S. Pat. No. 4,345,438 issued Aug. 24, 1982 to Labbe and Dutremble and assigned to the assignee of the present invention, the heat recovery steam generator is an essential part of a combined cycle plant linking the gas turbine plant and the steam turbine plant. Hot waste gases from the exhaust end of a gas turbine are channeled into the heat recovery steam generator past the fluid carrying tubes to convert feedwater into steam. Because of their utilization of gas turbine exhaust gas heat, combined cycle plants are among the most efficient power plants in the world.

Despite the foregoing claim to high efficiency, manufacturers of power generation equipment continue to search for improvements which will provide even greater efficiency. The present invention provides increased efficiency through an improved sidewall baffle design.

The inventors of the present invention have discovered that gas passing along the sidewalls of the HRSG and not channeled through the heat exchanger tube bank can result in an HRSG efficiency loss of up to two percent for a realistic gap of merely one inch between the sidewall and the adjacent tube fin tip. Because of the foregoing discovery, the inventors set out to provide a means for decreasing gas flow in the spaces between the tube bank and either sidewall of the HRSG. One attempt at solving this problem suggested the use of stationary baffles fixed to each sidewall upstream and downstream from the tube bank. The stationary baffles extended inwardly from the sidewalls to overlap the respective flow path along the sidewall thus diverting flow into the tube bank. This solution was found to be unsatisfactory because of the thermal growth of the tube bank which would cause clearances between the tube bank and the sidewall baffles to change allowing the resumption of undesirable flow along the HRSG sidewalls. Other designs known to the inventors include the installation of half tubes on the flat sidewall and the use of contoured sidewalls. In both cases, less effective bypass prevention results from the less resistive flow blockage, coupled with thermal differential expansion and manufacturing tolerance effects. Therefore the inventors discovered that it would be desirable to design sidewall baffles as part of the tube bundle.

SUMMARY OF THE INVENTION

The invention inhibits gas flow along the sidewalls of an HRSG by utilizing baffles to obstruct the gas flow path between the tube bundle and adjacent sidewalls. This redirects the sidewall gas flow through the tube bundle thereby increasing the efficiency of the heat exchanger. The problem of clearances between the sidewalls and baffles under conditions of tube bundle thermal growth have been solved by mounting the baffles on the tube bundle itself. The positioning of the baffles on the tube bundle has been optimized and the means for mounting the baffles to the tube bundle are disclosed.

OBJECTS OF THE INVENTION

It is an object of this invention to provide an HRSG having an improved thermal efficiency.

It is an object of this invention to provide an improved sidewall baffle design which will automatically accommodate thermal growth of a tube bundle and yet remain effective.

It is an object of this invention to provide an improved sidewall baffle design which may be easily attached to the tube bundle.

It is another object of this invention to provide a baffle arrangement which does not restrict the design placement of tubes within a tube bundle.

The novel features believed characteristic of the present invention are set forth in the claims. The invention itself, however, together with further objects and advantages thereof may best be understood with reference to the following description taken in connection with the drawings.

BRIEF DESCRIPTION OF THE DRAWINGS

FIG. 2 shows end 2A and side 2B views of the baffle.

FIG. 3 is a side elevation view of a portion of an HRSG tube bank showing the assembly of baffles to the tube bank.

DETAILED DESCRIPTION OF THE INVENTION

Figure 1:
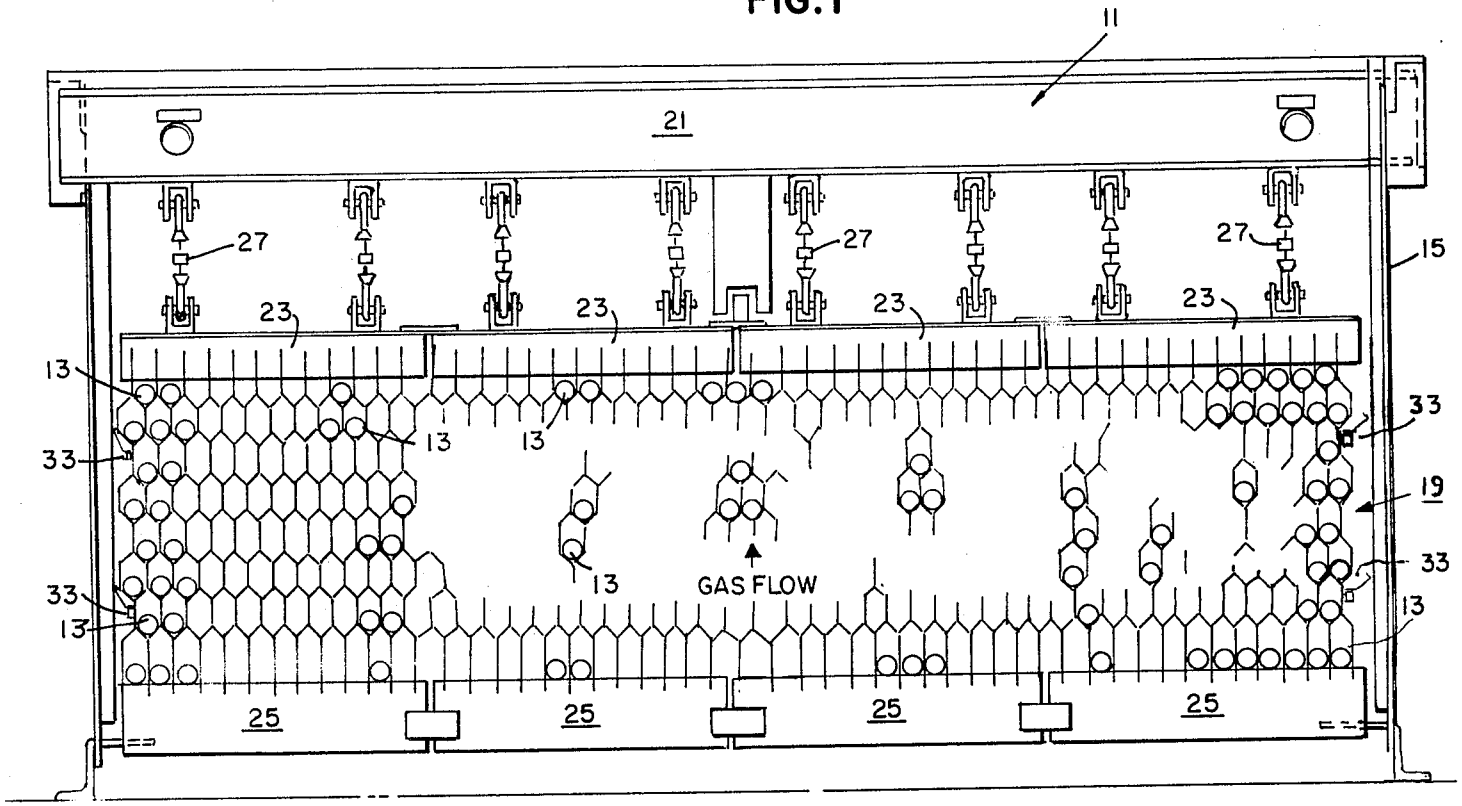
FIG. 1 is an end elevation view of an HRSG section showing the positioning of baffles in accordance with the present invention.

FIG. 1 is an end elevation view of a heat recovery steam generator box section 11. Those familiar with the construction of HRSG's know that typically an HRSG will contain an economizer, an evaporator and a superheater each of which may resemble the box section shown but when assembled comprise a multi-story structure. Further an end wall of the HRSG box has been removed along with interior thermal insulation which is used to insulate the end turns (not shown) of the fluid carrying tubes 13. The box includes sidewalls 15 which are comprised of stainless steel lagging and insulation. Gas flow direction in the box is from bottom to top as indicated.

The box includes tube support sheets 19 which hang vertically from support beams spaced apart in the axial direction with respect to the tubes. The tube support sheets each comprise several sections which are attached to upper support plates 23 and lower support plates 25. Thereafter adjacent support plates supporting tube sheet sections are welded together to form a tube sheet. The particular construction of the HRSG tube support sheets is shown in U.S. Patent application No. 440,800 filed Nov. 12, 1982 to inventors Cuscino et al, and assigned to the assignee of the present invention which is incorporated herein in its entirety by reference thereto. However, to complete the general description of the HRSG box, it is noted that the HRSG sheets are formed in a honeycomb structure and are suspended from the support beam 21 by links 27 through upper plates 23. In a typical HRSG with a 48 foot wide (in the direction of the tube axis) gas path, tube support sheets may be located at 4 foot intervals and include a support beam for each sheet.

Sidewall baffles 33 are mounted on the tube bundle in pairs so that there are a pair of sidewall baffles at the downstream end of the HRSG box with respect to the direction of gas flow and also there are a pair of baffles at the upstream end of the HRSG box. When optimizing heat exchanger design for a particular application, a performance/cost evaluation may be made to determine whether a pair of baffles located solely at the upstream end of the tube bundle will be adequate. The baffles are placed as close to the upstream and downstream ends respectively of the HRSG box as is physically permitted by the tube sheet structure. As shown in FIG. 1, the baffles are attached to the first indented portion of the tube support sheet most closely adjacent the respective support beams 23, 25 respectively. Other arrangements are possible for other configurations without departing from the scope of the invention. In this case it is clear that the baffles within a particular pair need not be at the exact same elevation with respect to one another and the tube bundle and that the placement of the baffle is determined by the tube support sheet geometry and the criteria that the respective baffle be as near as possible to the upstream gas entrance and the downstream gas exit as conveniently possible. For the honeycomb structure, this means attachment to the first full indented hanger strap. In addition, while the sidewall baffles are oriented in the configuration shown in FIG. 4 (pointed downstream) they may also be oriented in the configuration shown in FIG. 5 (pointed upstream). This placement maximizes the resistance to flow along the sidewall.

The baffle details are more clearly shown in FIG. 2 comprising views 2A and 2B. View 2A is a side view which shows the sidewall baffle 33 including a base 33A, a cantilever 33B and a lip 33C. The sidewall baffle 33 is attached to an angle member 35 which supports the sidewall baffle to form a baffle assembly. The sidewall baffle 33 is divided into baffle segments 37 each of which may be on the order of $1\frac{1}{2}$ feet in length. The angle support member may vary in length from 2 feet to 8 feet depending upon the manner in which it is fastened to the tube bundle. The baffle and angle support member are held together by means of a pin 39 and washer 41 whereupon the washer 41 is tack welded into place.

View 2B shows a typical baffle assembly which might be positioned between two honeycomb straps one of which is shown in FIG. 3. Both the baffle segment and the angle support are slotted and thus are allowed to expand differentially in the hot gas path. The baffle segment is fixed at the center 43 and allowed to expand in either direction. The attachment of the baffle assembly to the tube bundle for the example shown in 2B is at either end where no pin or washer is shown. The baffle assembly is not fixed at any particular point to the tube bundle and therefore is allowed to freely expand within the limits of the slots 45.

FIG. 3 shows the manner of attaching the baffle assembly to the tube support strap. The tube support strap is an elementary portion of the tube support sheet to which the baffle assembly may be attached as more clearly pointed out in the aforementioned U.S. Patent application No. 440,800. The vertical strap 51 is shown carrying finned tubes 53. A piece of bar stock 55 running approximately parallel to the tubes is welded to strap 51. At either end of the bar, a pin 57 is used to fasten an edge of a baffle assembly to the bar stock thus supporting the baffle assembly from tube sheet to tube sheet in the axial direction of the fluid carrying tubes. Again, a washer 59 is used to complete the fastening of the baffle assembly to the bar stock and strap whereupon the baffle assembly is free to expand because of its slotted construction previously identified by numeral 45.

Figure 4:
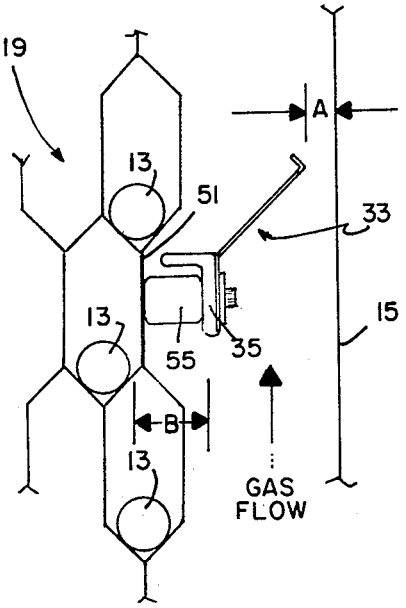
FIG. 4 is an enlarged end view of a typical HRSG tube bundle and sidewall showing applicable clearances.
Figure 5:
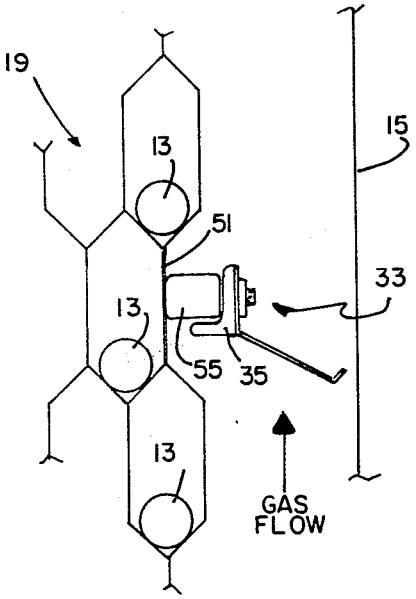
FIG. 5 is an alternative placement of the invention shown in FIG. 4.

FIGS. 4 and 5 show different modes of orientation with respect to the gas flow through the HRSG. In FIG. 4, the baffle extends in the direction of the gas flow whereas in FIG. 5 the baffle extends in a direction against the gas flow. The advantages of the embodiment shown in FIG. 5 is that the duct gas flow provides a closing force on the body portion of the baffle which tends to drive it against the sidewall tightening the seal.

In FIG. 4 dimension A is used to illustrate the recommended clearance between the baffle lip and sidewall. For a typical heat exchanger having a hot gas path on the order of 11 feet across this clearance should be maintained within a maximum of $\frac{3}{8}$ of an inch. Clearance B between the inside tube and the angle support is recommended to be a maximum of $\frac{1}{2}$ inch. Obviously these tolerance recommendations would be difficult to maintain if not for the flexibility the present invention provides to the HRSG design in total. The present invention not only renders possible the difficult task of manufacture with respect to the aforementioned clearance but also allows considerable adjustment of the tube formation in the tube bundle itself. This is because ultimately the baffles do not themselves require extensive realignment.

Another benefit of the invention not previously discussed is that the reduction in sidewall bypass flow reduces aerodynamic stimulus known to cause flow induced tube vibration and thereby enhance tube bundle reliability.

While there has been shown what is considered to be a preferred embodiment of the invention, other modifications may occur to those having skill in the art. It is intended to protect all such modifications as fall within the true spirit and scope of the invention.

What is claimed is:

1. An improved heat exchanger of the type comprising a gas carrying duct including sidewalls and endwalls and having a tube bundle disposed therein; the tube bundle comprising a plurality of substantially horizontal and parallel fluid carrying tubes; at least one tube support sheet disposed toward each opposite end of the tube bundle supporting the fluid carrying tubes wherein the improvement comprises:

a first pair of baffles, one on each side of the tube bundle and extending along the length of the tube bundle, each baffle being attached to the tube bundle and extending outwardly towards its respective adjacent sidewall; and, a second pair of baffles, one on each side of the tube bundle and extending along the length of the tube bundle, each baffle being attached to the tube bundle and extending outwardly towards its respective adjacent sidewall, said first baffles being downstream from said second baffles with respect to the duct gas flow direction.

2. The improvement recited in claim 1 wherein each baffle includes a baffle assembly comprising:

a structural member; and, at least one baffle segment attached to the structural member, said baffle segment having slots at each end and a hole between said slots whereby the baffle segment is free to slidably expand at each end but is fixed to the structural member at a point between the ends.

3. The improvement recited in claim 2 wherein the tube support sheet is a honeycomb structure including individual support straps alternately proximate to and indented from an adjacent sidewall therein the improvement further comprises:

a bar attached to an indented strap; and, at least one baffle assembly slidably attached to the bar.

4. The improvement recited in claim 2 wherein each baffle segment comprises:

a base portion attached to the structural member; and, a cantilever portion extending outwardly from the base portion and terminating in a free end.

5. The improvement recited in claim 3 wherein each baffle is attached to an indented strap portion closest to the gas entrance and exit with respect to the tube bundle.

6. The improvement recited in claim 4 wherein the improvement comprises a baffle segment having a cantilever portion which extends in the upstream direction.

7. An improved heat exchanger of the type comprising a gas carrying duct including sidewalls and endwalls and having a tube bundle disposed therein; the tube bundle comprising a plurality of substantially horizontal and parallel fluid carrying tubes; at least one tube support sheet disposed toward each opposite end of the tube bundle supporting the fluid carrying tubes, said tube support sheet having a honeycomb configuration whereby alternate support sheet side surfaces are indented with respect to the heat exchanger sidewalls, the improvement comprising:

at least one row of baffles disposed on each side of the tube bundle and extending in the same direction of the tube bundle; each baffle being attached to the tube bundle at an indented surface closest to the upstream end of the tube bundle with respect to the direction of exhaust gas flow.

8. The improvement recited in claim 7 wherein each baffle includes a cantilever portion extending outwardly from the tube bundle toward its respective sidewall.

9. The improvement recited in claim 8 wherein each baffle includes baffle segments which may expand and contract in accordance with thermal transients.

* * * * *